US008500988B2

(12) United States Patent
Lin et al.

(10) Patent No.: US 8,500,988 B2
(45) Date of Patent: Aug. 6, 2013

(54) DEVICE AND METHOD FOR ELID HONING

(75) Inventors: Weimin Lin, Saitama (JP); Hitoshi Ohmori, Saitama (JP); Yasutaka Yamamoto, Tokyo (JP); Jiro Maruyama, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 1047 days.

(21) Appl. No.: 12/294,710

(22) PCT Filed: Sep. 8, 2006

(86) PCT No.: PCT/JP2006/317824

§ 371 (c)(1),
(2), (4) Date: Sep. 26, 2008

(87) PCT Pub. No.: WO2007/110979

PCT Pub. Date: Oct. 4, 2007

(65) Prior Publication Data

US 2010/0240284 A1 Sep. 23, 2010

(30) Foreign Application Priority Data

Mar. 28, 2006 (JP) ..... 2006/087321

(51) Int. Cl.

| | |
|---|---|
| ***B23H 3/00*** | (2006.01) |
| ***B23H 5/00*** | (2006.01) |
| ***B23H 7/00*** | (2006.01) |
| ***B23H 9/00*** | (2006.01) |
| ***B23H 11/00*** | (2006.01) |
| ***C25F 3/00*** | (2006.01) |
| ***C25F 7/00*** | (2006.01) |
| ***H05K 3/07*** | (2006.01) |
| *B24B 1/00* | (2006.01) |
| *B24B 7/19* | (2006.01) |
| *B24B 7/30* | (2006.01) |

(52) U.S. Cl.
USPC ..... 205/640; 451/28; 451/51; 451/64; 451/119

(58) Field of Classification Search
USPC ..... 409/8; 451/51, 119; 205/640
See application file for complete search history.

(56) References Cited

U.S. PATENT DOCUMENTS

| | | | | |
|---|---|---|---|---|
| 4,274,925 | A * | 6/1981 | Bassler | 205/93 |
| 6,322,424 | B1 * | 11/2001 | Akagi | 451/28 |
| 6,994,610 | B1 * | 2/2006 | Aiura et al. | 451/51 |
| 2006/0124473 | A1 * | 6/2006 | Omori et al. | 205/674 |

FOREIGN PATENT DOCUMENTS

| | | | |
|---|---|---|---|
| JP | 06-155294 | | 6/1994 |
| JP | 07-096462 | | 4/1995 |
| JP | 7096462 | A | 4/1995 |
| JP | 09-057622 | | 3/1997 |
| JP | 09-277169 | | 10/1997 |
| JP | 2000-271852 | | 10/2000 |
| JP | 2001-062721 | | 3/2001 |
| JP | 2001062721 | A | 3/2001 |
| JP | 2002001657 | A * | 1/2002 |
| WO | WO 9924206 | A1 * | 5/1999 |

OTHER PUBLICATIONS

English machine translated "Detailed Description" for JP 2002001657 A, Jan. 2002, Omori et al.*

(Continued)

*Primary Examiner* — Bobby Ramdhanie
*Assistant Examiner* — Bryan Kilpatrick
(74) *Attorney, Agent, or Firm* — Griffin & Szipl, P.C.

(57) ABSTRACT

An ELID honing device includes a honing tool 10 positioned above a workpiece 1 having a hollow cylindrical inner surface, and vertically movable and rotationally drivable about a vertical rotation axis while being rockably suspended from an upper end, and a honing guide 20 positioned in proximity to an upper portion of the workpiece to guide the honing tool to the hollow cylindrical inner surface. The honing tool 10 has a fixed guide 12 having a predetermined radius R from the rotation axis to its outer peripheral surface, and honing stones 14*a* and 14*b* having outer peripheral surfaces movable in parallel from a diameter-increased position outside the radius R to a diameter-reduced position inside the radius R and capable of being electrolytically dressed. Further, the honing guide 20 has a hollow cylindrical ELID electrode 22 having an inner surface 22*a* for guiding an outer peripheral surface of the fixed guide of the honing tool and capable of being subjected to a negative voltage.

9 Claims, 10 Drawing Sheets

OTHER PUBLICATIONS

English translation of Chinese Office Action in corresponding Chinese Patent Application No. 20068054009.4 dated Nov. 6, 2009.

International Search Report issued in corresponding application No. PCT/JP2006/317824, completed Sep. 28, 2006 and mailed Oct. 10, 2006.

Microfilm of the Specification and drawings annexed to the request of Japanese Utility Model Application No. 177315/1978 (Laid-open No. 98561/1980), Tokyo Shibaura Electric Co., Ltd., Jul. 9, 1980.

"Elly and Ken's ABC's of ELID Grinding" (The NEXSYS Corporation 2012), at http://www.nexsys.co.jp/contents_e/technology.htm (downloaded Dec. 26, 2012), filed herewith as Exhibit A.

* cited by examiner

DEVICE AND METHOD FOR ELID HONING

This is a National Phase Application in the United States of International Patent Application No. PCT/JP2006/317824 filed Sep. 8, 2006, which claims priority on Japanese Patent Application No. 087321/2006, filed Mar. 28, 2006. The entire disclosures of the above patent applications are hereby incorporated by reference.

TECHNICAL FIELD OF THE INVENTION

The present invention relates to device and method for ELID honing for a hollow cylindrical inner surface.

DESCRIPTION OF THE RELATED ART

A honing device is conventionally used for machining of cylinder bores of automobile engines or the like. The honing device gives contact pressure radially outward to a square rod-shaped grinding stone in contact with a cylindrical inner surface, and gives reciprocating motion axially to a workpiece over its total length while rotating a honing head.

By the honing by the honing device, special machining streaks called cross hatching are formed on the inner surface of the workpiece. This cross hatching has a function to hold lubricating oil required in cylinder bores of engines or the like.

Generally, as the grinding stone for honing, a grinding stone, i.e., a grinding stone having high autogenous action such that the grinding stone itself is dressed (sharpened, hereinafter called "dressing" for short) simultaneously when machining the workpiece is selected.

However, since the dressing of the grinding stone depends on the autogenous action of the grinding stone itself, the cycle of the autogenous action is also influenced due to variations in machining accuracy in a previous process, manufacturing variations of the grinding stone, contamination of coolant, etc.

Therefore, in the conventional honing, it was necessary to frequently dress the grinding stone in order to solve clogging of a grinding stone, deterioration of surface roughness of a workpiece, extension of machining time, etc.

As dressing means of the honing stone, Patent Documents 1 to 3 are already disclosed.

Dressing means of Patent Document 1, as shown in FIG. 1, is one in which a tubular grinding stone dressing member 52 is supported by a turning member 50 in a position above a workpiece 51, the internal diameter of the grinding stone dressing member 52 is set to be approximately equal to the machining diameter of a grinding stone 58 in a honing tool 53, and a dressing grinding stone 54 for dressing the grinding stone 58 is disposed on the inner surface of the grinding stone dressing member 52.

According to this dressing means, while machining is performed by the honing tool 53, the honing tool 53 is inserted into the grinding stone dressing member 52 with suitable timing, and each grinding stone 58 is made to project, and is brought into contact with the dressing grinding stone 54. In this state, the grinding stone can be dressed with the grinding stone mounted on the honing tool by suitably driving the honing tool 53 reciprocally in its axial direction, and rotationally driving the honing tool.

The dressing means of Patent Document 2, as shown in FIG. 2, is one which performs the grinding stone dressing of bringing a grinding stone 63 provided at an outer peripheral portion of a honing head 61 into sliding contact with dressing abrasive 65 made of the same material as a workpiece to be machined by this honing head, thereby removing used abrasive grains on the surface of the grinding stone, and exposing new abrasive grains on the grinding stone surface.

According to this dressing means, the dressing of the grinding stone is performed using dressing abrasive made of the same material as a workpiece. Thus, when used abrasive grains cut from tips of the surface of the grinding stone are removed, and new abrasive grains whose tips become sharp cutting edges are exposed, the grinding stone is not used as the dressing abrasive even if the tips of the new abrasive grains grind the dressing abrasive at the time of dressing. Thus, troubles, such as abrasion of cutting edges at the tip of the grinding stone, and entering of abrasive grains on the side of the dressing abrasive into between the cutting edges of the grinding stone in the honing head, is avoided, so that proper grinding stone dressing can be performed.

The dressing means of Patent Document 3, as shown in FIG. 3, is one in which a metal-bonded grinding stone 72 for honing including abrasive grains, and a conductive binder which fixes these grains is fixed to a grinding stone holder 76 for electrolytic dressing, an electrode 78 is made to face a grinding stone machining surface with a predetermined spacing therefrom, and a predetermined voltage is applied to between the grinding stone and the electrode, and simultaneously, conductive grinding lubricant is supplied between the grinding stone and the electrode, thereby electrolytically dressing of metal-bonded portions on the surface of the grinding stone.

By this dressing means, the metal-bonded portions on the surface of the grinding stone can be electrolytically dressed selectively. Thereby, the amount of projections of the abrasive grains can be optimized depending on electrolytic voltage and time, and machining with small machining load and higher efficiency can be stabilized.

Patent Document 1: Japanese Patent Publication Laid-Open No. 07-096462, "Honing Device"

Patent Document 2: Japanese Patent Publication Laid-Open No. 09-277169, "Grinding stone Dressing Method and Dressing Device of Honing Head"

Patent Document 3: Japanese Patent Publication Laid-Open No. 2001-62721, "Electrolytic Dressing Method and Device of Honing stone"

There were the following problems in the above-described conventional dressing means.

The dressing means of Patent Document 1 has the structure in which the cylindrical dressing grinding stone and the insertion guide are reversed 180°. Thus, in order to perform dressing, additional processes (cycle peculiar to the dressing), such as reversion of the cylindrical dressing grinding stone, positioning of the height of the dressing grinding stone, and the rotation of the dressing grinding stone, become necessary. Therefore, time loss is caused, and the honing cycle becomes long due to dressing time.

Further, since there is neither reference of completion of the dressing nor reference of timing with which dressing is performed, it cannot determined that machining accuracy is not measured. Therefore, adaptation is difficult for the mass production line where continuous operation is made. Moreover, the replacement time of a dressing grinding stone is also indefinite.

In the dressing means of Patent Document 2, the same material as a workpiece is used as the dresser without providing a dressing grinding stone. However, dressing cannot be performed during machining, it is necessary to perform the dressing in another cycle. Thus, the time loss is heavy.

In the dressing means of Patent Document 3, the electrode has a circular-arc shape. Therefore, it is necessary to position the metal-bonded grinding stone 72 at the same height as the electrode 78, and to rotate the metal-bonded grinding stone 72 in that height, and extra dressing processes (cycle peculiar to the dressing) is required.

That is, additional processes (cycle peculiar to dressing) other than a normal honing process are indispensable in the dressing means of the conventional honing stone. Therefore, there were problems in that the time loss by the additional processes other than the honing process is caused, and the honing cycle becomes long.

Further, in a case where the electrolytic in-process dressing grinding method currently disclosed in Patent Document 3 (hereinafter referred to as ELID grinding method) is used as the dressing means, there was a problem in that an electric current flows to a workpiece via a coolant (conductive grinding lubricant) interposed between a workpiece and an electrode for ELID, which are adjacent to each other, and the workpiece is electrolyzed and begins to corrode electrolytically.

The invention has been originated in order to solve the aforementioned problems.

That is, the object of the invention is to ELID honing device and method, capable of dressing a honing stone without additional processes (cycle peculiar to dressing), and thereby, preventing clogging of the grinding stone, deterioration of surface roughness, extension of machining time, etc. for a prolonged period of time without changing a honing cycle, and allowing adaptation to a mass production line where continuous operation is made, and preventing electrolytic corrosion of a workpiece.

SUMMARY OF THE INVENTION

According to the invention, there is provided an ELID honing device comprising a honing tool positioned above a workpiece having a hollow cylindrical inner surface to be honed, and vertically movable and rotationally drivable about a vertical rotation axis while being rockably suspended from an upper end, and a honing guide positioned in proximity to an upper portion of the workpiece to guide the honing tool to the hollow cylindrical inner surface. The honing tool has a fixed guide having a predetermined radius R from the rotation axis to its outer peripheral surface, and honing stones having outer peripheral surfaces movable in parallel from a diameter-increased position outside the radius R to a diameter-reduced position inside the radius and capable of being electrolytically dressed. The honing guide has a hollow cylindrical ELID electrode having an inner surface for guiding an outer peripheral surface of the fixed guide of the honing tool and capable of being subjected to a negative voltage.

According to a preferred embodiment of the invention, the honing guide has a grinding lubricant supply port which almost uniformly supplies conductive grinding lubricant to a gap between the ELID electrode and a honing stone passing through the inside of the electrode.

The honing guide has a corrosion-resistant electrode positioned below the ELID electrode, close to the upper portion of the workpiece, and capable of being subjected to a positive voltage.

Further, according to the invention, there is provided an ELID honing method including a honing tool positioned above a workpiece having a hollow cylindrical inner surface to be honed, and vertically movable and rotationally drivable about a vertical rotation axis while being rockably suspended from an upper end, and a honing guide positioned in proximity to an upper portion of the workpiece to guide the honing tool to the hollow cylindrical inner surface. The honing tool has a fixed guide having a predetermined radius R from the rotation axis to its outer peripheral surface, and honing stones having outer peripheral surfaces movable in parallel from a diameter-increased position outside the radius R to a diameter-reduced position inside the radius and capable of being electrolytically dressed. The honing guide has a hollow cylindrical ELID electrode having an inner surface for guiding an outer peripheral surface of the fixed guide of the honing tool and capable of being subjected to a negative voltage. The honing method includes pouring a conductive grinding lubricant into a gap between the honing stones and the ELID electrode to electrolytically dress the honing stones while the honing stones are held in the diameter-reduced position and the fixed guide of the honing tool is guided by an inner surface of the ELID electrode; and then inserting the honing tool into the workpiece, and thereafter moving the honing stones to the diameter-increased position and rotationally driving the moving stones to hone the hollow cylindrical inner surface.

According to a preferred embodiment of the invention, the honing tool is caused to descend or ascend while being guided, and simultaneously the honing stones are electrolytically dressed.

The honing stones are electrolytically dressed without rotation of the honing tool or with the rotation of the honing tool, with the honing stones held in the diameter-reduced position.

According to the device and method of the invention described above, the conductive grinding lubricant is poured into the gap between the honing stones and the ELID electrode to electrolytically dress the honing stones while the honing stones are held in the diameter-reduced position and the fixed guide of the honing tool is guided by the inner surface of the ELID electrode. Thus, the honing stones can be dressed without additional processes (cycle peculiar to dressing).

Accordingly, clogging of a grinding stone, deterioration of surface roughness, extension of machining time, etc. can be prevented for a prolonged period of time without changing a honing cycle, and adaptation to a mass production line where continuous operation is made is allowed.

Further, an electric current flows into the corrosion-resistant electrode via the coolant (conductive grinding lubricant) interposed between the corrosion-resistant electrode and the electrode for ELID by providing the honing guide with the corrosion-resistant electrode which is positioned below the ELID electrode, is close to the upper portion of the workpiece, and is capable of being subjected to a positive voltage. Thus, electrolytic corrosion of the workpiece can be prevented by suppressing electrolysis of the workpiece.

DESCRIPTION OF THE PREFERRED EMBODIMENT

Hereinafter, a preferable embodiment of the invention will be described with reference to the drawings.

Figure 1:
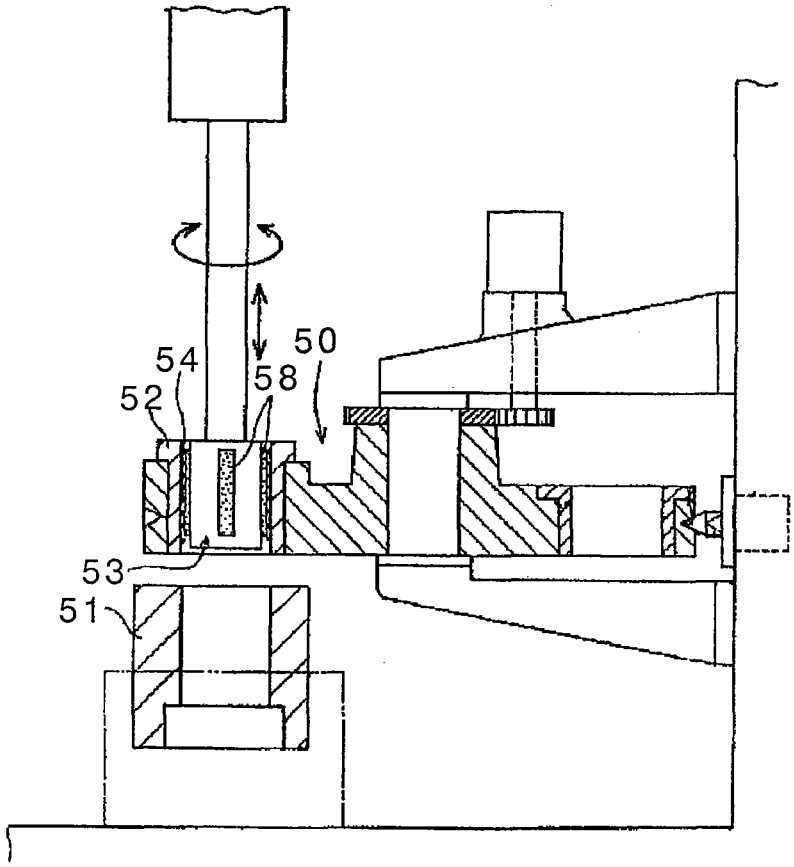
Fig.1 Prior Art
FIG. 1 is a schematic view of dressing means of Patent Document 1.
Figure 2:
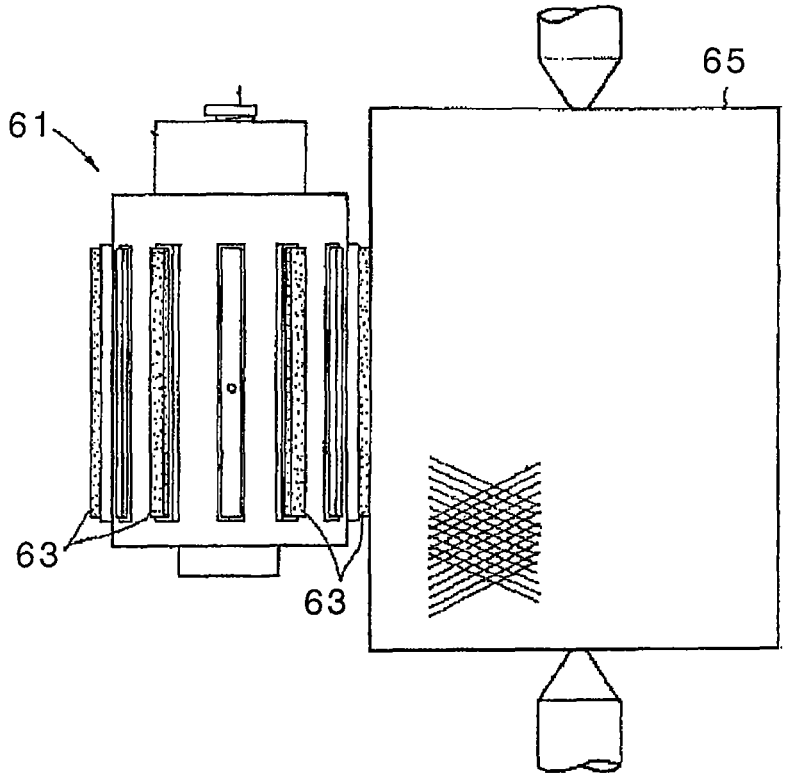
Fig.2 Prior Art
FIG. 2 is a schematic view of dressing means of Patent Document 2.
Figure 3:
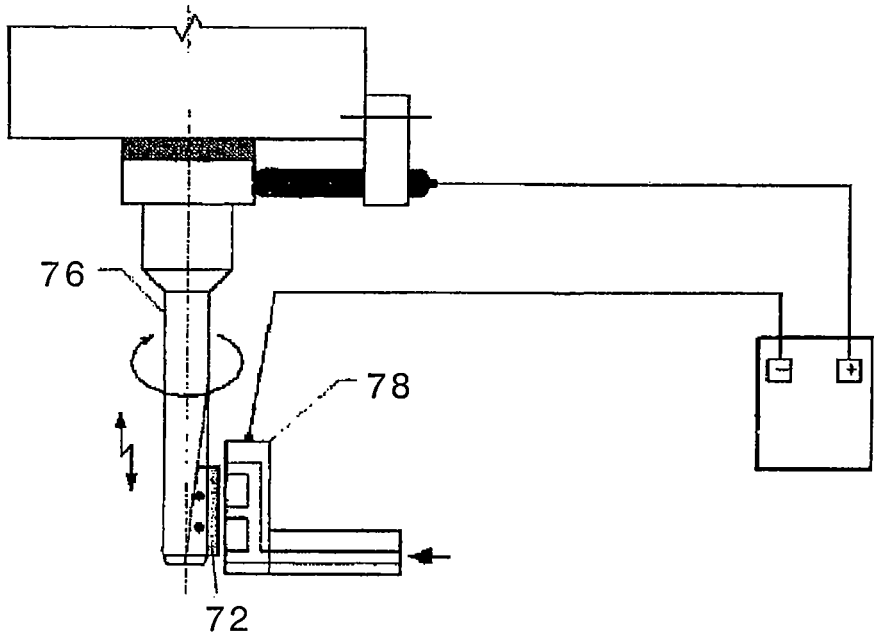
Fig.3 Prior Art
FIG. 3 is a schematic view of dressing means of Patent Document 3.
Figure 4:
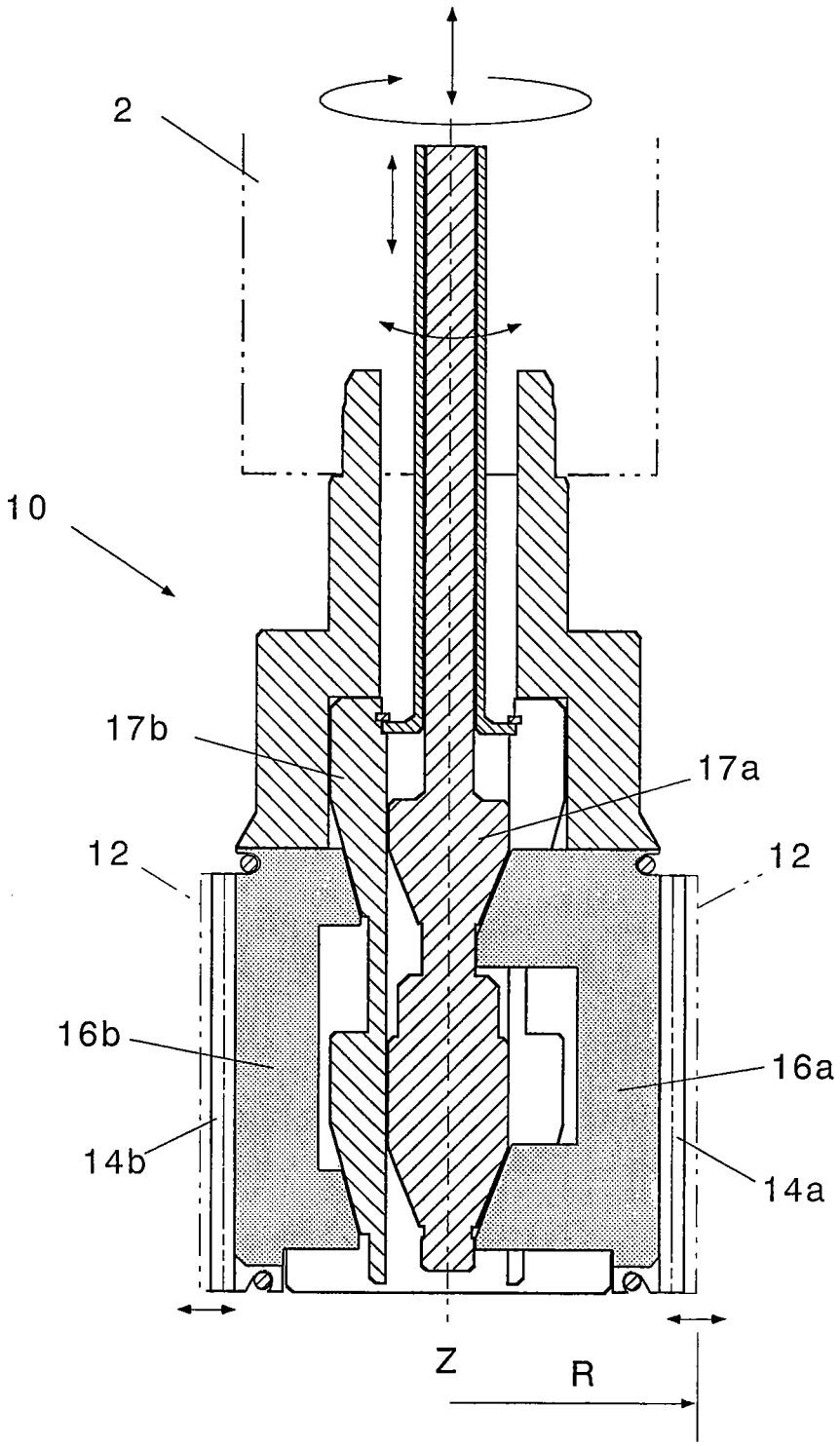
FIG. 4 is a configuration diagram of a honing tool of the invention.

FIG. 4 is a configuration diagram of a honing tool of the invention.

The honing tool 10 of the invention is positioned above a workpiece 1 (not shown) having a hollow cylindrical inner surface to be honed, such as cylinder bores of an engine, and is configured so as to be vertically movable and rotationally drivable about a vertical rotation axis Z while being rockably suspended from an upper end thereof, by means of a driving unit 2 (honing head).

Further, the honing tool 10 has a fixed guide 12 and honing stones 14*a* and 14*b*.

The fixed guide 12 has a constant radius R from the rotation axis Z to an outer peripheral surface. The fixed guide 12 is made of insulating materials, such as ceramic, and three or more fixed guides are provided at regular integrals in the peripheral direction.

The honing tool 10 contains an air micro unit (not shown) which makes precision measurement of a gap between the outer surface of the fixed guide 12, and a machining surface close thereto.

The honing stones 14*a* and 14*b* are configured such that their outer peripheral surfaces are movable in parallel from a diameter-increased position outside the radius R of the outer peripheral surface of the fixed guide 12 to a diameter-reduced position inside the radius. The honing stones 14*a* and 14*b* are, for example, metal-bonded grinding stones including abrasive grains and a conductive binder which fixes these grains.

In this embodiment, the honing stone 14*a*, which is a grinding stone for roughening, is fixed to an outer periphery of a first expansion/contraction member 16*a* which is provided so as to be movable radially, and is moved in parallel from the diameter-increased position to the diameter-reduced position by the axial movement of a first expansion/contraction shaft 17*a* including a tapered outer surface which rubs a tapered inner surface of the first expansion/contraction member 16*a*.

Further, in this embodiment, the honing stone 14*b*, which is a grinding stone for finishing, is fixed to an outer periphery of a second expansion/contraction member 16*b* which is provided so as to be movable radially, and is moved in parallel from the diameter-increased position to the diameter-reduced position by the axial movement of a second expansion/contraction shaft 17*b* including a tapered outer surface which rubs a tapered inner surface of the second expansion/contraction member 16*b*.

The first expansion/contraction shaft 17*a* and second expansion/contraction shaft 17*b* is adapted to be capable of being driven at any time during use of the honing tool 10 by the driving unit which is not shown.

Further, the honing stones 14*a* and 14*b* are configured such that they are connected to a positive electrode (+electrode) of a power source for electrolytic dressing (ELID power source) which is not shown, and are capable of being subjected to a positive voltage.

Figure 5:
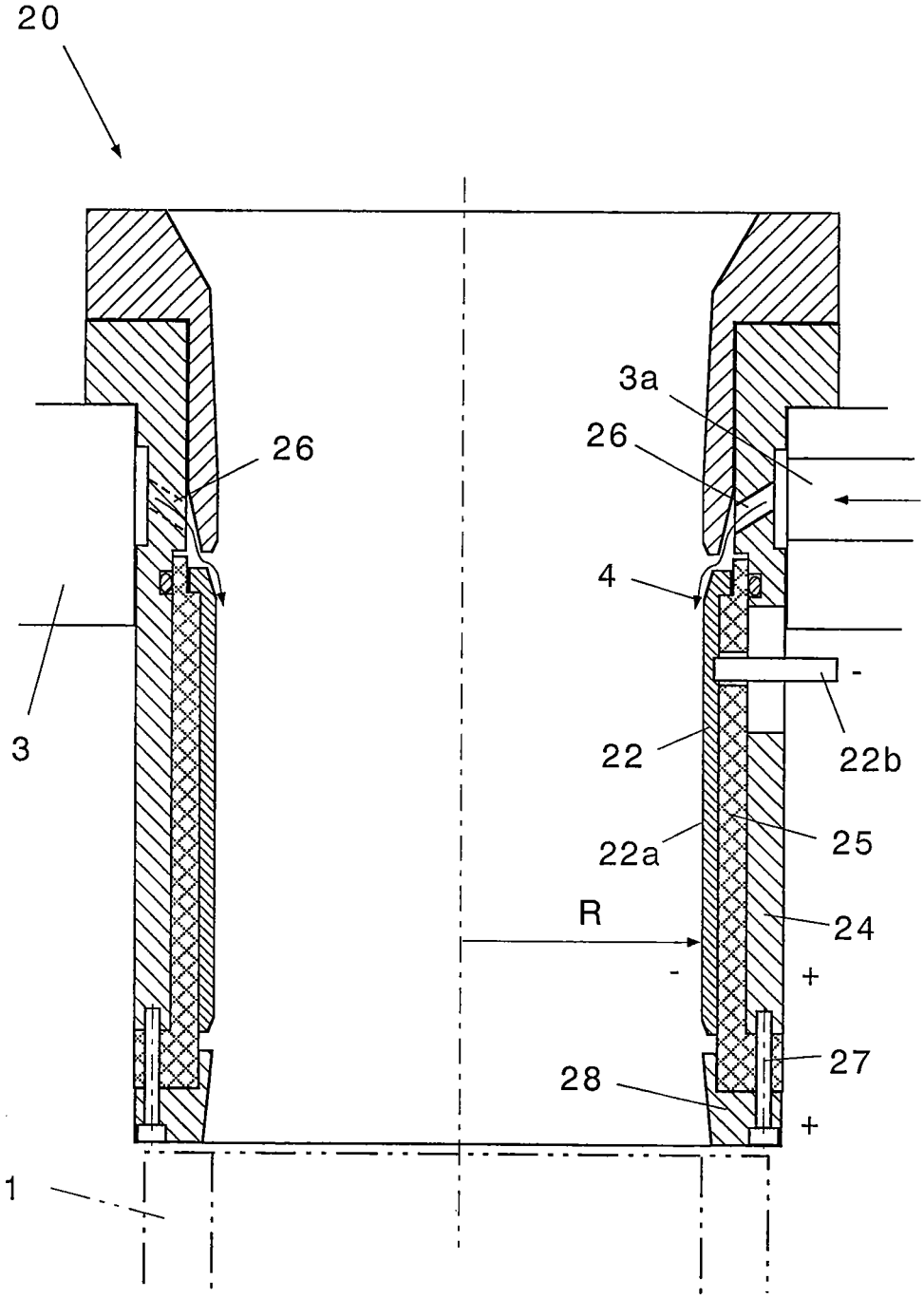
FIG. 5 is a configuration diagram of a honing guide of the invention.

FIG. 5 is a configuration diagram of a honing guide of the invention.

The honing guide 20 of the invention is positioned in proximity with an upper portion of the workpiece 1 having a hollow cylindrical inner surface to be honed, and has a function to guide the honing tool 10 to the hollow cylindrical inner surface of the workpiece 1.

The honing guide 20 has an ELID electrode 22. Further, the ELID electrode 22 has an inner surface 22*a* which guides the outer peripheral surface of the fixed guide 12 of the honing tool 10, and is configured such that it is capable of being subjected to a negative voltage via a terminal 22*b* connected to a negative electrode (−electrode) of the power source for electrolytic dressing (ELID power source) which is not shown.

Although the ELID electrode 22 preferably has a hollow cylindrical shape without cut, it may include a plurality of circular-arc surfaces, and there may be a cut between the circular-arc surfaces. Further, although the vertical length of the ELID electrode 22 is preferably equal to or greater than that of the honing stones 14*a* and 14*b*, it may be shorter than the vertical length of the honing stones.

In addition, referring to this drawing, guide body 24 represents a hollow cylindrical guide body which surrounds the ELID electrode 22, and reference numeral 25 is an insulating ring which is positioned between the ELID electrode 22 and the guide body 24 to insulate them therefrom.

The honing guide 20 further has a grinding lubricant supply port 26. In this embodiment, the grinding lubricant supply port 26, which is a plurality of through holes provided obliquely downward in the upper portion of the guide body 24, is adapted to almost equally supply conductive grinding lubricant (coolant) to a gap between the ELID electrode 22 and the honing stones 14*a* and 14*b* which pass through the inside of the electrode, via a flow passage 3*a* provided in a fixing member 3 of the honing guide 20.

The honing guide 20 further has a corrosion-resistant electrode 28 below the ELID electrode 22. The corrosion-resistant electrode 28 is close to an upper portion of the workpiece 1, and is connected to the positive electrode (+electrode) of the power source for electrolytic dressing (ELID power source) which is not shown, and is capable of being subjected to a positive voltage.

In addition, in this embodiment, the corrosion-resistant electrode 28 and the guide body 24 are connected together by a conductive bolt 27, and both of them are capable of being subjected to a positive voltage.

Figure 6:
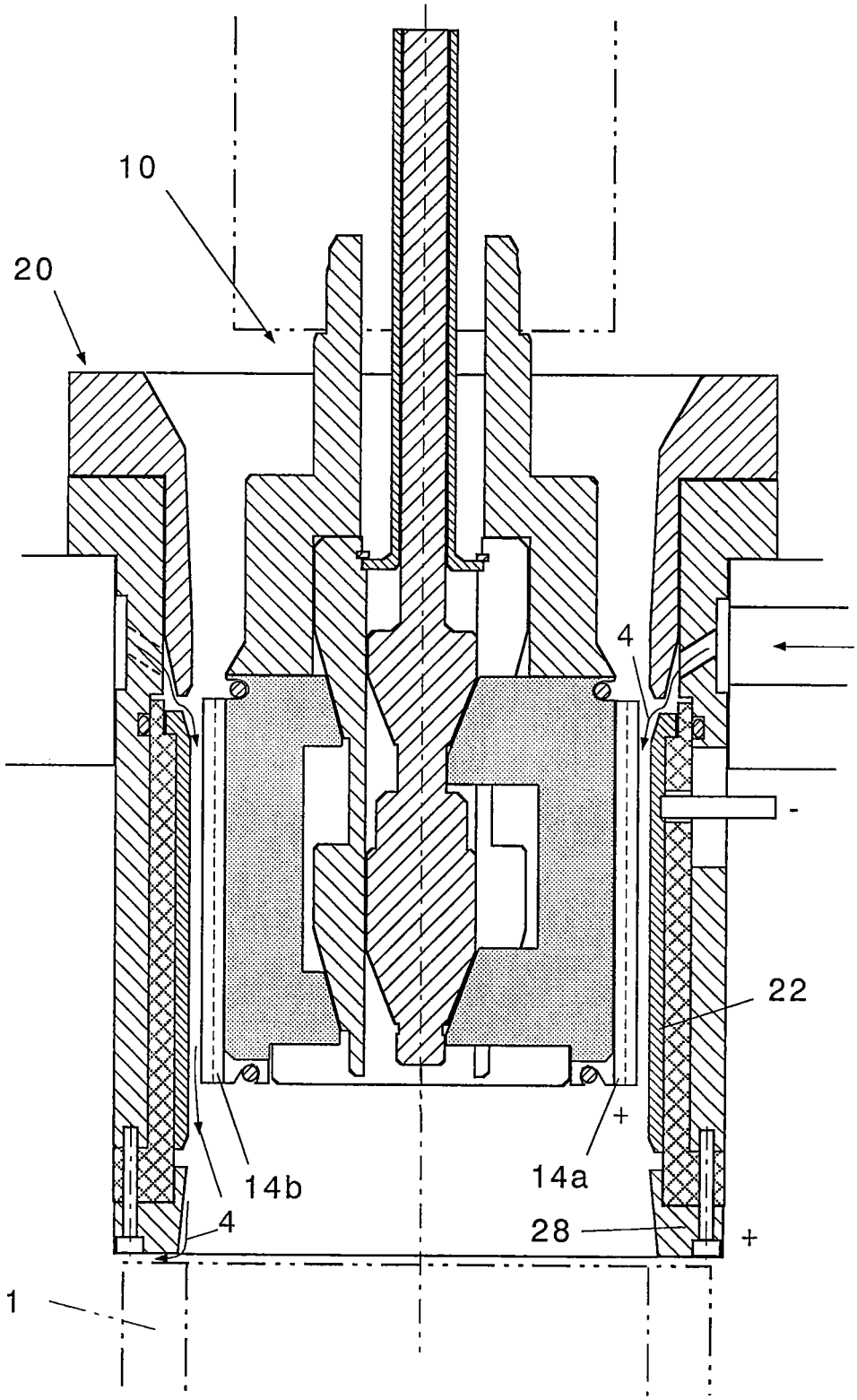
FIG. 6 is a configuration diagram of an ELID honing device of the invention.

FIG. 6 is a configuration diagram of an ELID honing device of the invention, showing a state where the honing stones 14*a* and 14*b* are electrolytically dressed.

In the ELID honing method of the invention, the conductive grinding lubricant 4 is poured into the gap between the honing stones 14*a* and 14*b* and the ELID electrode 22 to electrolytically dress the honing stones 14*a* and 14*b* while the honing stones 14*a* and 14*b* are held in the diameter-reduced position and the fixed guide 12 of the honing tool 10 is guided by the inner surface 22*a* of the ELID electrode.

The gap between the honing stones 14*a* and 14*b* in the diameter-reduced position and the ELID electrodes 22 is set to the spacing suitable for electrolytic dressing, for example, about 1 to 5 mm.

In this electrolytic dressing process, it is preferable to raise or lower the honing tool 10 while being guided by the honing guide 20, and to electrolytically dress the honing stones 14*a* and 14*b* simultaneously. However, the honing tool may be stopped in an intermediate position if necessary.

Further, it is preferable to electrolytically dress the honing stones 14*a* and 14*b* without rotating the honing tool 10 while the honing stones 14*a* and 14*b* are held in the diameter-reduced position. However, the honing tool may be rotated if necessary.

Next, after the honing tool 10 is inserted into the workpiece 1, the honing stones 14*a* and 14*b* are moved to the diameter-increased position to rotationally drive the honing tool 10 and to hone the hollow cylindrical inner surface of the workpiece 1.

According to the device and method of the invention described above, when the honing tool 10 is guided to the hollow cylindrical inner surface of the workpiece 1 by the honing guide 20, the conductive grinding lubricant 4 is poured into the gap between the honing stones 14*a* and 14*b* and the ELID electrode 22 to electrolytically dress the honing stones 14*a* and 14*b* while the honing stones 14*a* and 14*b* are held in the diameter-reduced position and the fixed guide 12 of the honing tool 10 is guided by the inner surface 22*a* of the ELID electrode 22. Thus, the honing stones can be dressed without additional processes (cycle peculiar to dressing).

Accordingly, clogging of a grinding stone, deterioration of surface roughness, extension of machining time, etc. can be prevented for a prolonged period of time without changing a honing cycle, and adaptation to a mass production line where continuous operation is made is allowed.

Further, an electric current flows into the corrosion-resistant electrode 28 via the coolant (conductive grinding lubricant 4) interposed between the corrosion-resistant electrode 28 and the electrode 22 for ELID by providing the honing guide 20 with the corrosion-resistant electrode 28 which is positioned below the ELID electrode 22, is close to the upper portion of the workpiece 1, and is capable of being subjected to a positive voltage. Thus, electrolytic corrosion of the workpiece can be prevented by suppressing electrolysis of the workpiece 1.

Example 1

Figure 7:
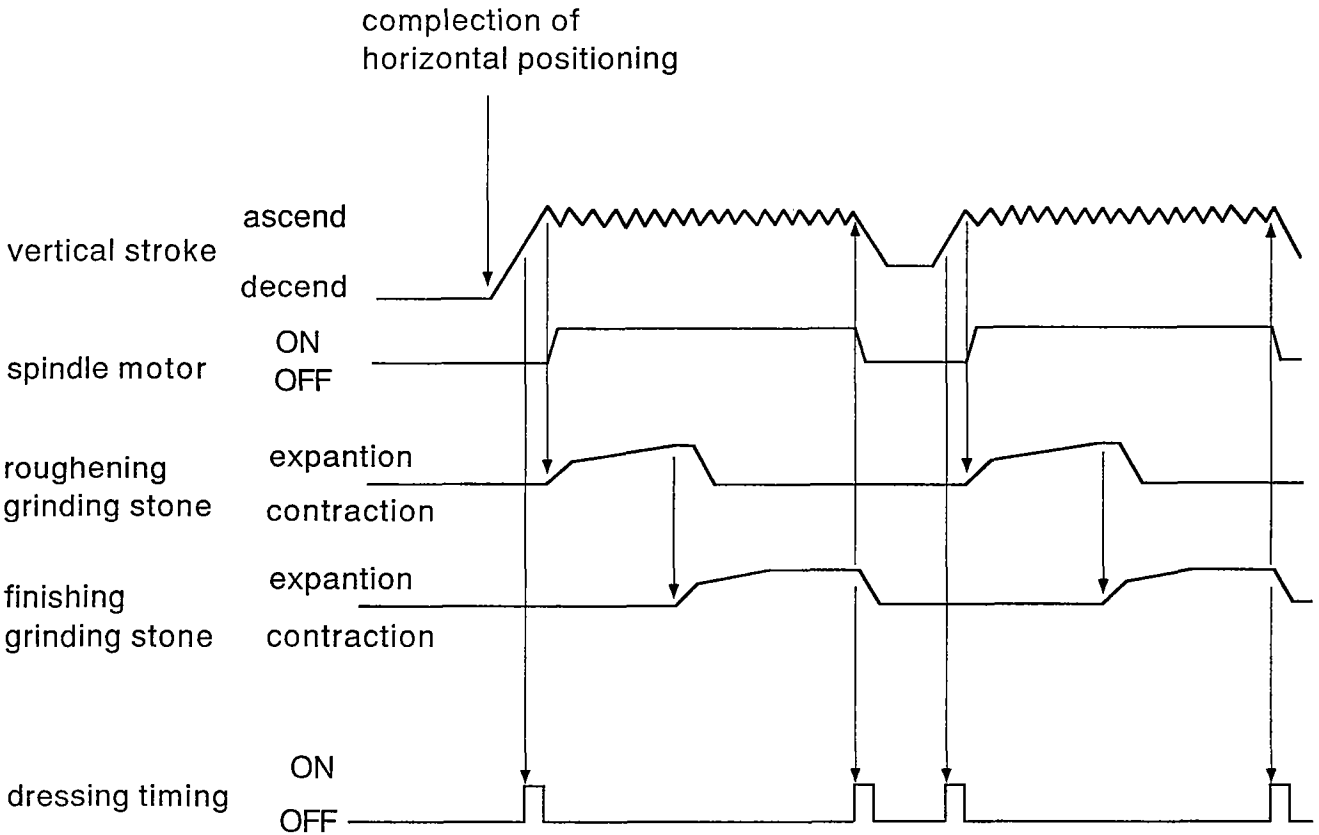
FIG. 7 is a sequence cycle view showing an example of the invention.

FIG. 7 is a sequence cycle view showing an example of the invention. In this drawing, the vertical stroke represents the ascending/descending operation of the honing tool 10, the spindle motor represents the rotation (ON) and stop (OFF) of the honing tool 10, the roughening grinding stone represents expansion/contraction of the honing stone 14*a*, the finishing grinding stone represents expansion/contraction of the honing stone 14*b*, and the dressing timing represents the timing of voltage application of the honing stones 14*a* and 14*b*, the ELID electrode 22, and the corrosion-resistant electrode 28.

Further, in this drawing, the axis of abscissa represents the lapse of time, and the longitudinal arrows represent the timing of the sequence.

As shown in this drawing, after the completion of horizontal positioning by the honing guide 20 with respect to the hollow cylindrical inner surface of the workpiece 1, the honing tool 10 descends from the honing guide 20, and after the honing tool 10 is inserted into the hollow cylindrical inner surface of the workpiece 1, the honing tool 10 is made to move up and down while being rotated. Further, a gap from a machining surface is roughened to a predetermined position by expanding the roughening grinding stone, and is detected by an air micro unit. Subsequently, the gap from the machining surface is finished to a predetermined position by expanding the finishing grinding stone.

By sequentially repeating these processes, a number of workpieces can be honed without time loss.

In this embodiment, the dressing timing is provided in the ascending operation and descending operation of the vertical stroke. This ascending operation and descending operation are operations which cause the honing tool 10 to ascend and descend after completion of honing of a current hollow cylindrical inner surface, thereby allowing the honing tool to be inserted into the honing guide 20, and cause the honing tool 10 to ascend and descend for honing of the next the hollow cylindrical inner surface, and are determined from the cycle time of a mass production line independently of dressing timing. Dressing time is set to the time (in this example: 0.2 to 0.3 seconds) sufficiently shorter than the cycle time.

Accordingly, electrolytic dressing is allowed without changing a honing cycle, clogging of a grinding stone, deterioration of surface roughness, extension of machining time, etc. can be prevented for a prolonged period of time, and adaptation to a mass production line where continuous operation is made is allowed. In addition, the dressing timing is provided only in any one of the ascending operation and descending operation.

Example 2

Next, the surface texture accuracy of the honing surface according to the invention will be described.

Figure 8:
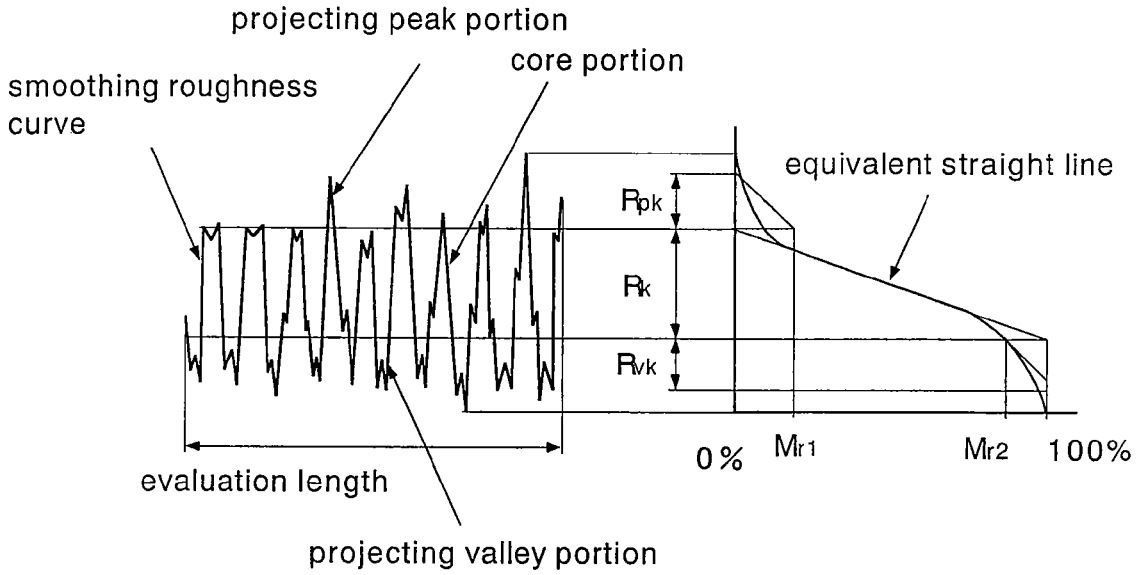
FIG. 8 is an explanatory view of load curves.

FIG. 8 is an explanatory view of load curves. In this drawing, the left figure illustrates a smoothing roughness curve in evaluation length, and includes projecting peak portions, a core portion, and projecting valley portions.

Further, the right figure illustrates a linear load curve defined by JIS. The load curve is a figure obtained by plotting the load length ratio (tp) on the axis of abscissa and plotting the height (height to cut) direction of a measurement curve on the axis of ordinate.

In this drawing, $R_k$ is the level difference of the core portion, $R_{pk}$ is the height of the projecting peak portions, and the average height of the projecting peak portions above the core portion, and $R_{vk}$ is the depth of the projecting valley portions and the average depth of the projecting valley portions below the core portion.

Further, $M_{r1}$ is the load length ratio of the core portion, and the load length ratio of an intersection points between a parting line of the projecting peak portions and the core portion, and the load curve, and $M_{r2}$ is the load length ratio of the core portion, and is the load length ratio of an intersection point between a parting line of the projecting valley portion and the core portion, and the load curve.

In honing of cylinder bores of automobile engines or the like, as the surface roughness suitable for a cylinder bore, it is preferable that $R_{pk}$ (height of the projecting peak portions) be small so that a piston may slide on the inside of the cylinder bore, and that the core portion has moderate roughness (for example, about 0.1 to 0.6 Ra) in order to hold lubricating oil.

Figure 9A:
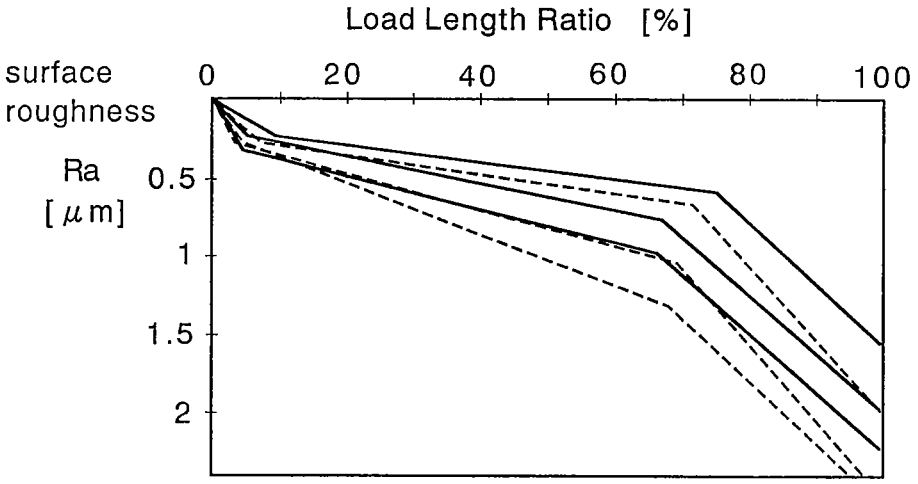
FIG. 9A and FIG. 9B are comparison charts of load curves showing the example of the invention.
Figure 9B:
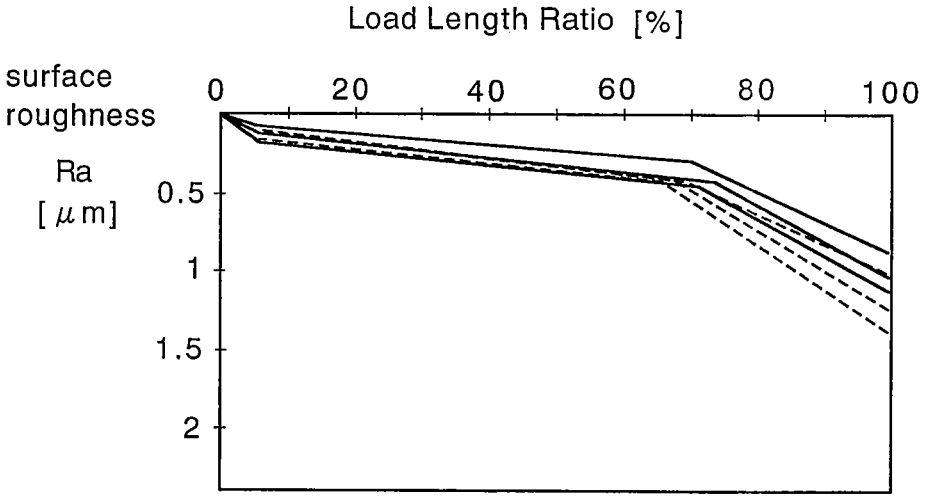

FIG. 9A and FIG. 9B are comparison charts of load curves showing the example of the invention. In this drawing, FIG. 9A illustrates a conventional example (without ELID), and FIG. 9B illustrates a case of the invention (with ELID). In addition, electrolytic dressing conditions are a voltage of 90 V, a current of 2 A, and a voltage application time of 1 μs (ON)/1 μs (OFF).

These drawings show that, after a number of workpieces (10 or more) were honed, every two workpieces which sampled at random were measured in three spots (mouth, middle, back), respectively.

In the conventional example (without ELID) of FIG. 9A, it is found that whole variations are large, and the surface roughness of the core portion is also out of a desired range (for example, about 0.1 to 0.6 Ra).

In contrast, in the invention (with ELID) of FIG. 9B, it turns out that, since variations are small, and the surface roughness of the core portion also sufficiently falls within a desired range (for example, about 0.1 to 0.6 Ra), the surface roughness suitable for cylinder bores of engines is obtained.

Figure 10A:
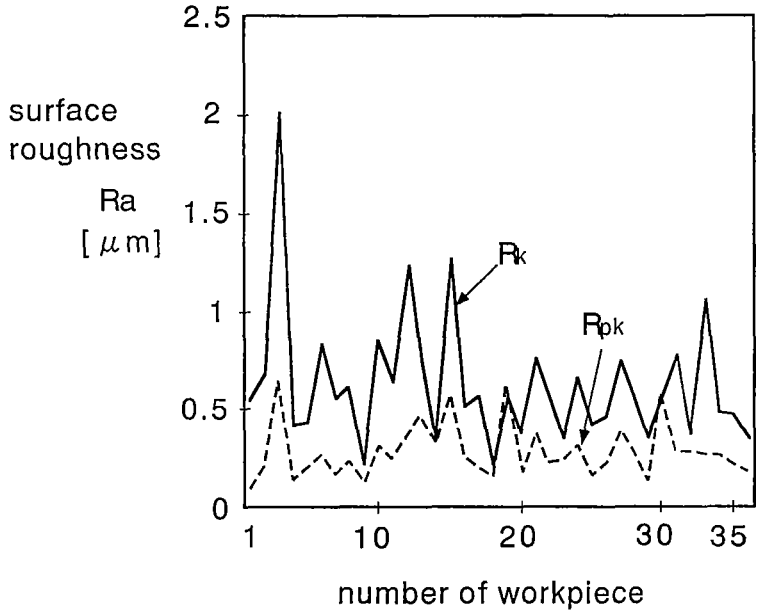
FIG. 10A and FIG. 10B are other comparison charts of machining surface roughness showing the example of the invention.
Figure 10B:
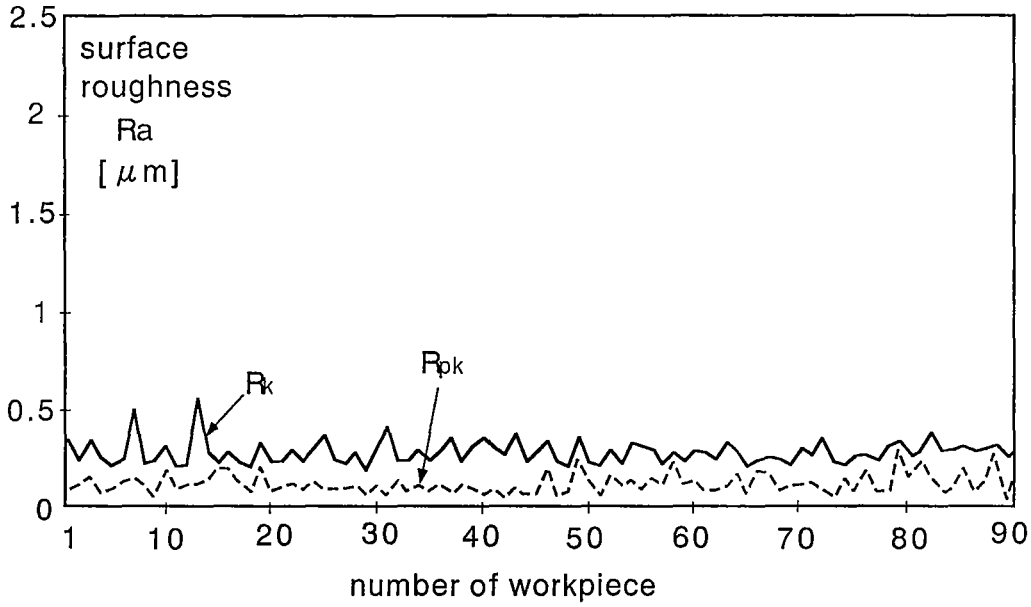

FIG. 10A and FIG. 10B are other comparison charts of machining surface roughness showing the example of the invention. In this drawing, FIG. 10A illustrates a conventional example (without ELID), and FIG. 10B illustrates a case of the invention (with ELID).

$R_k$ (level difference of the core portion) and $R_{pk}$ (height of the projecting peak portions) as the surface roughness important to engines are compared in these drawings. In addition, $R_{vk}$ (depth of the projecting valley portions) was almost equal.

In the conventional example (without ELID) of FIG. 10 A, it turns out that whole variations are large in both of $R_k$ and $R_{pk}$ within a range in which the number of times of machining is 1 to 35.

In contrast, in the invention (with ELID) of FIG. 10 B, it turns out that variations are small in both of $R_k$ and $R_{pk}$ within a range in which the number of times of machining is 1 to 90, and the surface roughness is small.

Further, honing was done with and without the corrosion-resistant electrode 28 in the invention. As a result, the upper surface of the workpiece 1 was electrolytically corroded for a short time in a case where a corrosion-resistant electrode was not provided, but the upper surface of the workpiece was not electrolytically corrode at all in a case where the corrosion-resistant electrode was provided.

As described above, the invention is ELID honing means in which a special dressing cycle is not provided, and includes the cylindrical electrode 22 also serving as the honing guide disposed on a machining shaft.

The honing tool 10 is guided by the cylindrical honing guide 20, and is inserted into the workpiece 1. The electrode 22 is provided in the honing guide 20, and performs the electrolytic dressing of the honing stones 14*a* and 14*b* while the honing tool 10 passes through the cylindrical honing guide 20.

Further, the honing guide 20 has the structure in which the coolant 4 which allows optimal electrolytic dressing during approach can be supplied.

By this configuration, even if a special dressing cycle is not given to the conventional honing cycle, it was confirmed in the above example that the effect of improving machining accuracy is obtained.

In the invention, since dressing is made little by little whenever the honing tool 10 descends/ascends, the state of being always cut off can be maintained. Accordingly, this dressing is not dressing depending on the autogenous action of the conventional grinding stone.

In addition, it should be understood that the invention is not limited to the above embodiment, but various modifications may be made without departing from the spirit and scope of the invention.

The invention claimed is:

1. An ELID, electrolytic in-process dressing, honing device comprising:

(a) a honing tool positionable above a workpiece having a hollow cylindrical inner surface to be honed, wherein the honing tool is vertically movable and rotationally drivable about a vertical rotation axis while rockably suspended from an upper end; and (b) a honing guide positioned in proximity to an upper portion of the workpiece to guide the honing tool to the hollow cylindrical inner surface, wherein the honing tool has i. a fixed guide having a predetermined radius R from the vertical rotation axis to an outer peripheral surface of the fixed guide; and ii. a plurality of honing stones having outer peripheral surfaces movable in parallel from a diameter-increased position outside the radius R to a diameter-reduced position inside the radius R and operable to be electrolytically dressed, and wherein the honing guide has a hollow cylindrical ELID electrode having an inner surface for guiding the outer peripheral surface of the fixed guide of the honing tool and the hollow cylindrical ELID electrode is subjectable to a negative voltage, and wherein the honing guide has a corrosion-resistant electrode positioned below the ELID electrode, proximate the upper portion of the workpiece, and the corrosion-resistant electrode is subjectable to a positive voltage.

2. The ELID honing device according to claim 1, wherein the honing guide also has a grinding lubricant supply port thaw which supplies conductive grinding lubricant to a gap between the ELID electrode and a honing stone passing through the inside of the ELID electrode.

3. An ELID, electrolytic in-process dressing, honing method comprising the following steps:

(a) pouring a conductive grinding lubricant into a gap between a plurality of honing stones and a hollow cylindrical ELID electrode to electrolytically dress the honing stones while the honing stones are held in a diameter-reduced position and a fixed guide of a honing tool is guided by an inner surface of the ELID electrode, wherein the honing tool is positioned above a workpiece having a hollow cylindrical inner surface to be honed, and the honing tool is vertically movable and rotationally drivable about a vertical rotation axis while rockably suspended from an upper end, and a honing guide is positioned in proximity to an upper portion of the workpiece to guide the honing tool to the hollow cylindrical inner surface, wherein the honing guide comprises i. the hollow cylindrical ELID electrode having the inner surface for guiding an outer peripheral surface of the fixed guide of the honing tool and the hollow cylindrical ELID electrode is subjectable to a negative voltage; and ii. a corrosion-resistant electrode positioned below the ELID electrode, proximate the upper portion of the workpiece, and the corrosion-resistant electrode is subjectable to a positive voltage, wherein the fixed guide of the honing tool has a predetermined radius from the vertical rotation axis to ants outer peripheral surface of the fixed guide, and the honing stones have outer peripheral surfaces movable in parallel from a diameter-increased position outside the radius to the diameter-reduced position inside the radius;

(b) inserting the honing tool into the workpiece; and (c) moving the honing stones to the diameter-increased position and rotationally driving the moving stones to hone the hollow cylindrical inner surface.

4. The ELID honing method according to claim 3, wherein the honing tool descends or ascends while guided, and simultaneously, the honing stones are electrolytically dressed.

5. The ELID honing method according to claim 3, wherein the honing stones are electrolytically dressed without rotation of the honing tool or with the rotation of the honing tool.

6. An ELID, electrolytic-in-process dressing, honing device comprising:

(a) a hollow honing guide adapted to be positioned above and immediately proximate an upper portion of a hollow workpiece, wherein the hollow honing guide has an ELID electrode disposed on an inner periphery and a corrosion-resistant electrode positioned below the ELID electrode, proximate the upper portion of the hollow workpiece, and the corrosion-resistant electrode is subjectable to a positive voltage;

(b) a honing tool reciprocally disposed in the hollow honing guide, wherein the hollow honing guide is configured to guide the honing tool into the hollow work piece; and (c) a first and a second honing stone, wherein the first and second honing stones are respectively supported on a first and a second expansion/contraction member, wherein the first and second expansion/contraction members are radially displaceable with respect to each other.

7. The ELID honing device according to claim 6, wherein the first and second expansion/contraction members each have tapered inner surfaces that engage respective tapered external surfaces of axially movable first and second expansion/contraction shafts, wherein the first and second expansion/contraction shafts are operatively connected with a driving unit that individually moves the first and second expansion/contraction shafts with respect to one another to individually force the first and second expansion/contraction members radially outward.

8. The ELID honing device according to claim 6, wherein the first honing stone is a roughening grinding stone and wherein the second honing stone is a finishing grinding stone.

9. The ELID honing device according to claim 6, wherein the ELID electrode is a hollow cylindrical ELID electrode having an inner surface for guiding an outer peripheral surface of the honing tool and the ELID electrode is subjectable to a negative voltage.

* * * * *